US006616009B2

(12) United States Patent
Yang

(10) Patent No.: US 6,616,009 B2
(45) Date of Patent: Sep. 9, 2003

(54) TICKET VENDING MACHINE

(75) Inventor: Wen-Fu Yang, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 0 days.

(21) Appl. No.: 10/062,485

(22) Filed: Feb. 5, 2002

(65) Prior Publication Data

US 2003/0146232 A1 Aug. 7, 2003

(51) Int. Cl.[7] ..... B65H 5/28
(52) U.S. Cl. ..... 221/71; 83/699.11
(58) Field of Search ..... 221/7, 9, 13, 70, 221/71, 33, 45, 63, 258, 25; 83/202, 210, 438, 648, 651, 697, 699.11, 856, 857

(56) References Cited

U.S. PATENT DOCUMENTS 4,060,177 A * 11/1977 Surber, Jr. ..... 221/25
4,367,666 A * 1/1983 Toth ..... 82/203

* cited by examiner

*Primary Examiner*—Kenneth W. Noland
(74) *Attorney, Agent, or Firm*—Rabin & Berdo, P.C.

(57) ABSTRACT

A ticket vending machine includes a face panel defining a ticket passageway and a ticket outlet at one end of the ticket passageway, a side plate mounted with an axle for holding a ticket roll, a sheet-transfer cylinder assembly controlled to transfer the continuous ticket sheet of the ticket roll to the ticket outlet, a cutting unit disposed between the sheet-transfer cylinder assembly and the ticket passageway and controlled to reciprocate a cutting plate and to cut off the continuous ticket sheet.

6 Claims, 7 Drawing Sheets

TICKET VENDING MACHINE

BACKGROUND OF THE INVENTION

1. Field of the Invention

The present invention relates to game machines and, more specifically, to a ticket vending machine, which prevents the people from damaging the continuous ticket sheet of the ticket roll or stealing it.

2. Description of the Related Art

FIGS. 6 and 7 illustrate a ticket-vending machine according to the prior art. According to this design, a toothed cutting plate A3 is fixedly fastened to a cutter rack A4, keeping the toothed cutting edge A31 above the top side of the cutter rack A4; the cutter rack A4 has two mounting flanges A41 respectively fastened to two side boards A11 of the machine base A1; an impression plate A5 is provided having two pivot rods A51 respectively coupled to a respective pivot hole A111 of the side boards A11 and two bearing portions A52 supported on the side boards A11; a face panel A2 is fastened to front lugs A112 of the base frame A1, having a ticket outlet A21 aimed at a guide face A42 of the cutter rack A4. This structure of ticket vending machine is complicated, resulting in high manufacturing cost. Further, when the user pulls out the continuous ticket sheet of the ticket roll, the continuous ticket sheet may not be properly cut off by the toothed cutting edge of the toothed cutting plate.

SUMMARY OF THE INVENTION

The present invention has been accomplished under the circumstances in view. It is one object of the present invention to provide a ticket vending machine, which prevents people from damaging the continuous ticket sheet of the ticket roll or stealing it. To achieve this and other objects of the present invention, the ticket vending machine comprises a base frame; a face panel fixedly mounted on a front side of the base frame, the face panel having a ticket outlet; a side plate fixedly vertically mounted on one lateral side of the base frame remote from the face panel; an axle perpendicularly fixedly mounted on the side plate and suspended above the base frame and holding a ticket roll for enabling the lead end of the continuous ticket :sheet of the ticket roll to be extended to the ticket outlet of the face panel; a control unit mounted in the base frame, the control unit comprising a control circuit board, a gear box, and a sheet-transfer cylinder assembly, and controlled by the control circuit board to transfer the continuous ticket sheet of the ticket roll to the ticket outlet of the face panel; and a cutting unit mounted inside the base frame between the gear box and the face panel and adapted to cut off the continuous ticket sheet of the ticket roll. The face panel is comprised of a first shell and a second shell fastened together. The first shell and the second shell have respective guides defining a passageway adapted to guide the continuous ticket sheet of the ticket roll from the sheet-transfer cylinder assembly to the ticket outlet for enabling the continuous ticket sheet of the ticket roll to be cut by the cutting unit. The cutting unit comprises a horizontal cutting hole through which the continuous ticket sheet of the ticket roll passes from the sheet-transfer cylinder assembly to the ticket outlet, and a cutting plate controlled to reciprocate over the cutting hole and to cut off the continuous ticket sheet of the ticket roll.

DETAILED DESCRIPTION OF THE PREFERRED EMBODIMENT

Figure 1:
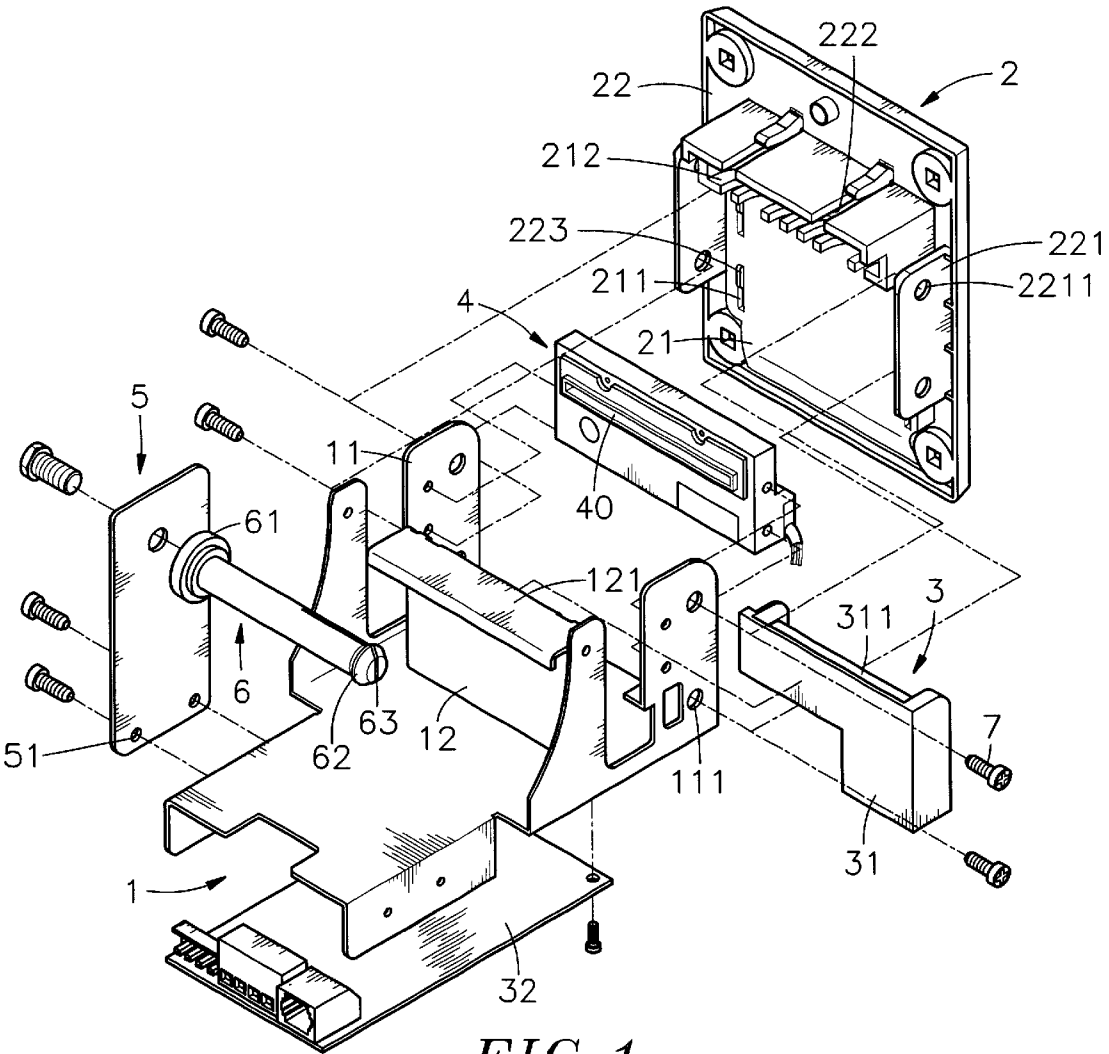
FIG. 1 is an exploded view of a ticket vending machine according to the present invention.

Referring to FIGS. from 1 through 4, a ticket vending machine in accordance with the present invention is shown comprised of a base frame 1, a face panel 2, a control unit 3, a cutting unit 4, a side frame 5, and a shaft 6.

The base frame 1 comprises two upright sidewalls 11 disposed at two opposite lateral sides, screw holes 111 in the upright sidewalls 11, a vertical mounting wall 12 connected between the upright sidewalls 11, and a transverse bearing face 121 disposed at the top side of the vertical mounting wall 12.

The face panel 2 is comprised of a first shell 21 and a second shell 22. The first shell 21 comprises a plurality of retaining slots 211, and a plurality of top guides 212. The second shell 22 comprises two side plates 221 perpendicularly extended from the back sidewall thereof at two sides, the side plates 221 each having a plurality of screw holes 2211, a back guide 222 disposed above the elevation of the side plates 221, and a plurality of retaining rods 223. The retaining rods 223 of the second shell 22 are respectively fastened to the retaining slots 211 of the first shell 21. After connection of the second shell 22 to the first shell 21, the guides 212 and 222 define a passageway 23 and a ticket outlet 24 at one end of the passageway 23.

The control unit 3 is comprised of a gear box 31, and a circuit board 32. The gear box 31 comprises a gear set (not shown), and a sheet-transfer cylinder assembly 311 coupled to the gear set. The circuit board 32 is fixedly fastened to the bottom side of the base frame 1.

The cutting unit 4 comprises a motor 41, a conical screw rod 411 axially connected to the output shaft of the motor 41, an eccentric gear wheel 42 meshed with the conical screw rod 411, a coupling rod 421 fixedly perpendicularly extended from one side of the eccentric gear wheel 42, a D-shaped block 422 fixedly provided at the other side of the eccentric gear wheel 42, a sensor 44 coupled to the D-shaped block 422, a cutting hole 40, a cutting plate 45, and a substantially V-shaped link 43 coupled between the cutting plate 45 and the coupling rod 421. The link 43 has one end provided with an elongated sliding slot 431 and coupled to the coupling rod 421, the other end coupled to a fixed rod 46, and a middle part coupled to the cutting plate 45 by a slip joint 451. The cutting plate 45 has a substantially V-shaped cutting edge 452 disposed in parallel to the cutting hole 40.

The side frame 5 comprises a plurality of bottom screw holes 51 fixedly fastened to one lateral side of the base frame 1 near the backside by screws.

The axle 6 has a fixed end 61 fixedly fastened to the side frame 5, and a free end terminating in an end flange 62 having an axially extended split 63. The split 63 enables the end flange 62 to be radially inwardly compressed during the loading of a ticket roll.

Figure 2:
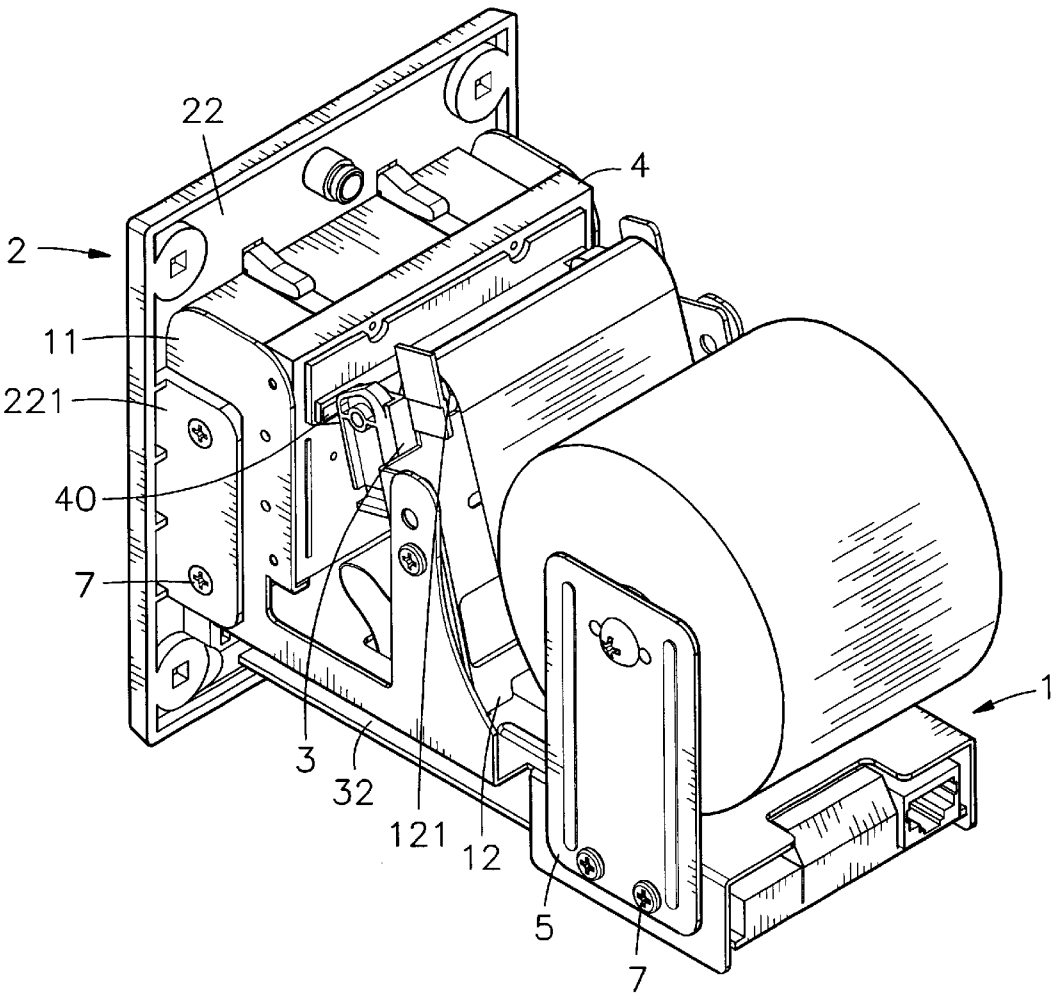
FIG. 2 is an elevational assembly view of the ticket vending machine shown in FIG. 1.
Figure 3:
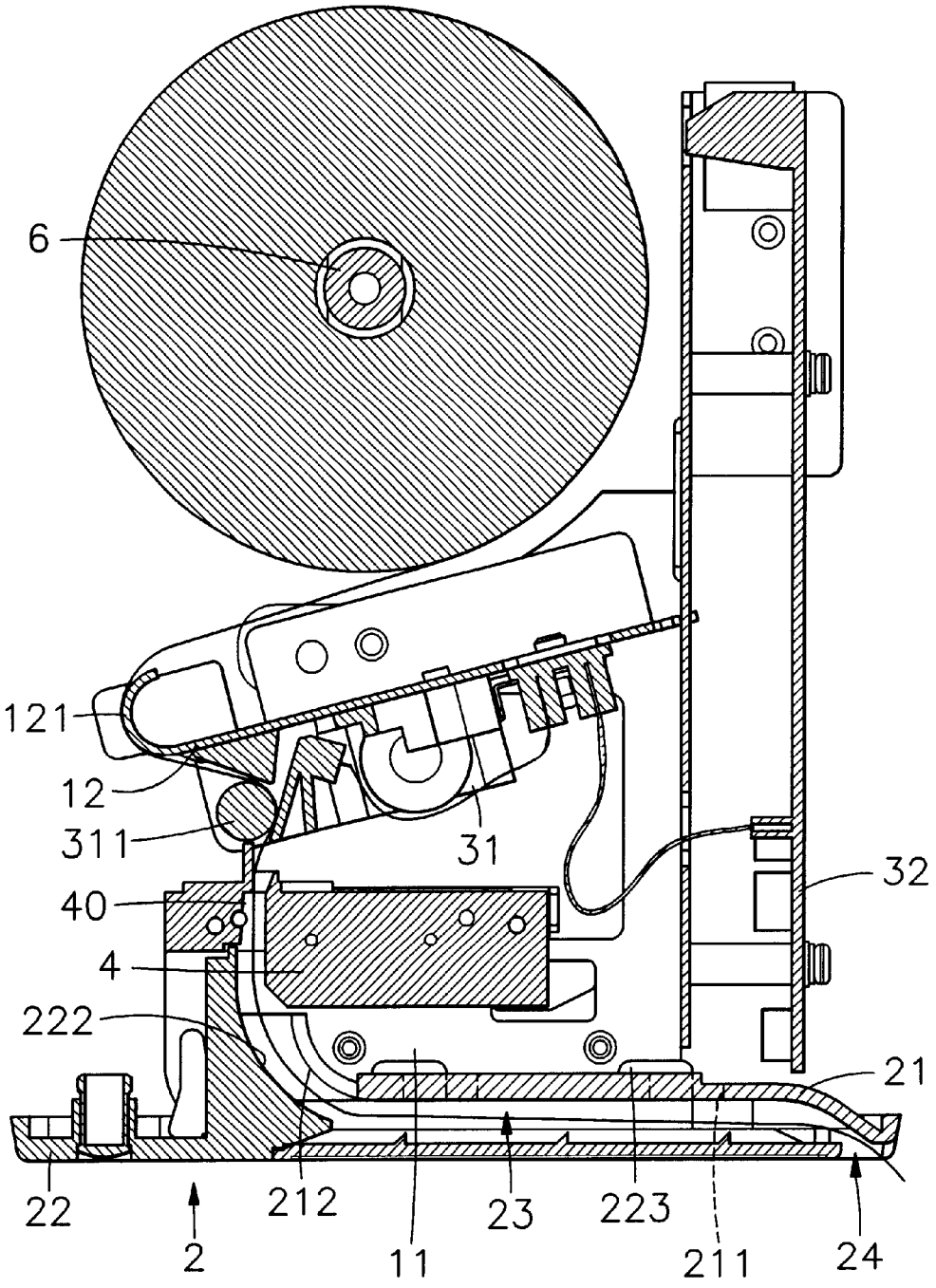
FIG. 3 is a side view in section of FIG. 2.
Figure 4:
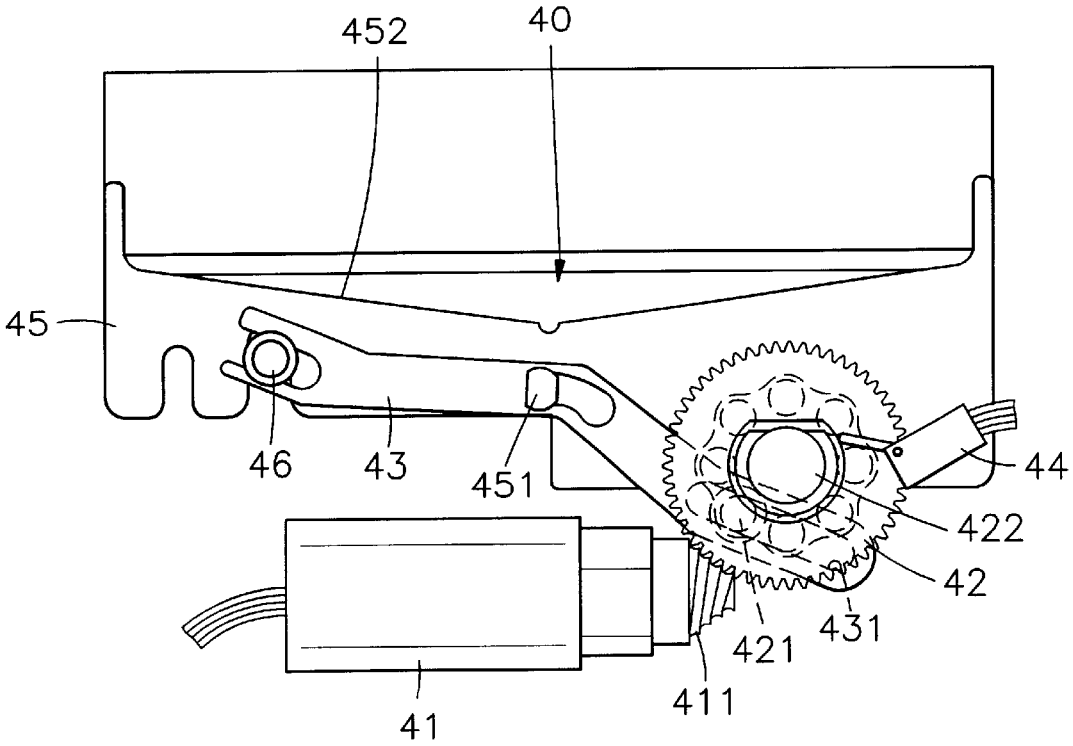
FIG. 4 is a schematic drawing showing the status of the cutting unit before cutting.

The assembly process of the ticket vending machine is outlined hereinafter with reference to FIGS. 1 and 2 again, the fixed end 61 of the axle 6 is fixedly fastened to the side frame 5, by a screw, and then the side frame 5 is fixedly fastened to one side of the base frame 1 by screws, and then the gear box 31 of the control unit 3 is fixedly fastened to the vertical mounting wall 12 of the base frame 1, and then the circuit board 32 of the control unit 3 is fixedly fastened to the bottom side of the base frame 1 by screws, and then the cutting unit 4 is fixedly fastened to the base frame 1 between the upright sidewalls 11, and then the screw holes 2211 of the side plates 221 of the face panel 2 are respectively fastened to the screw holes 111 of the upright sidewalls 11 of the base frame 1 by screws 7. When assembled, the cutting hole 40 of the cutting unit 4 is disposed above the guides 212 and 222 of the face panel 2.

Figure 5:
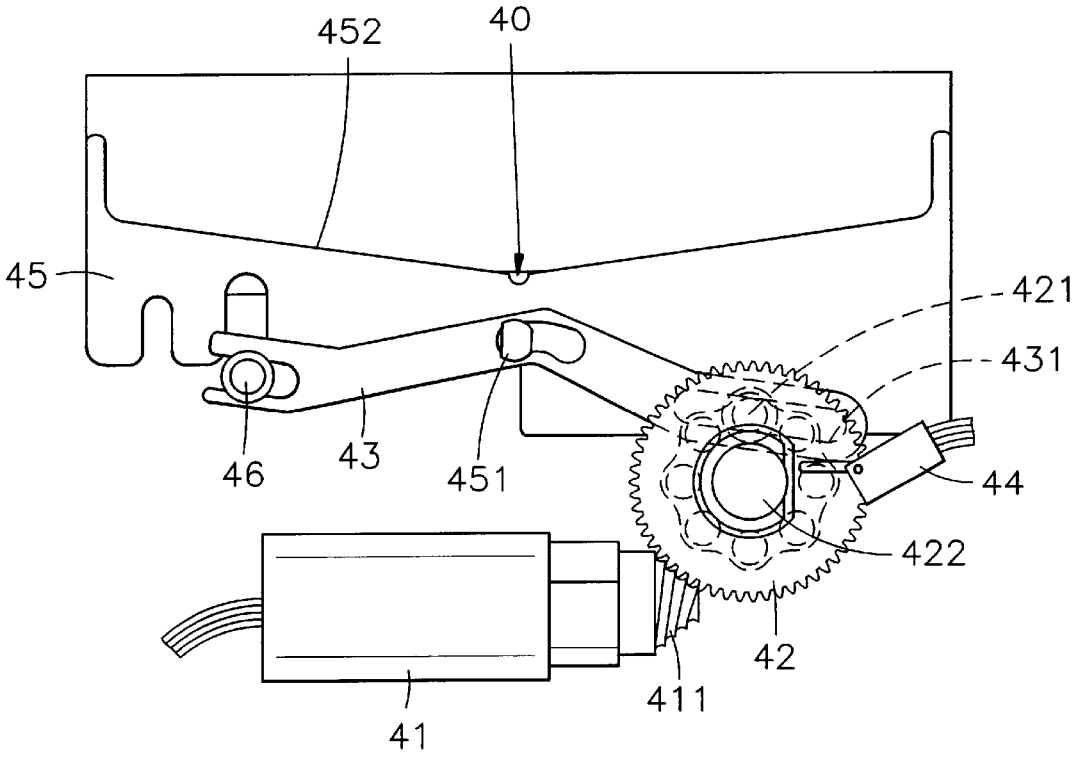
FIG. 5 is a schematic drawing showing the status of the cutting unit after cutting.
Figure 6:
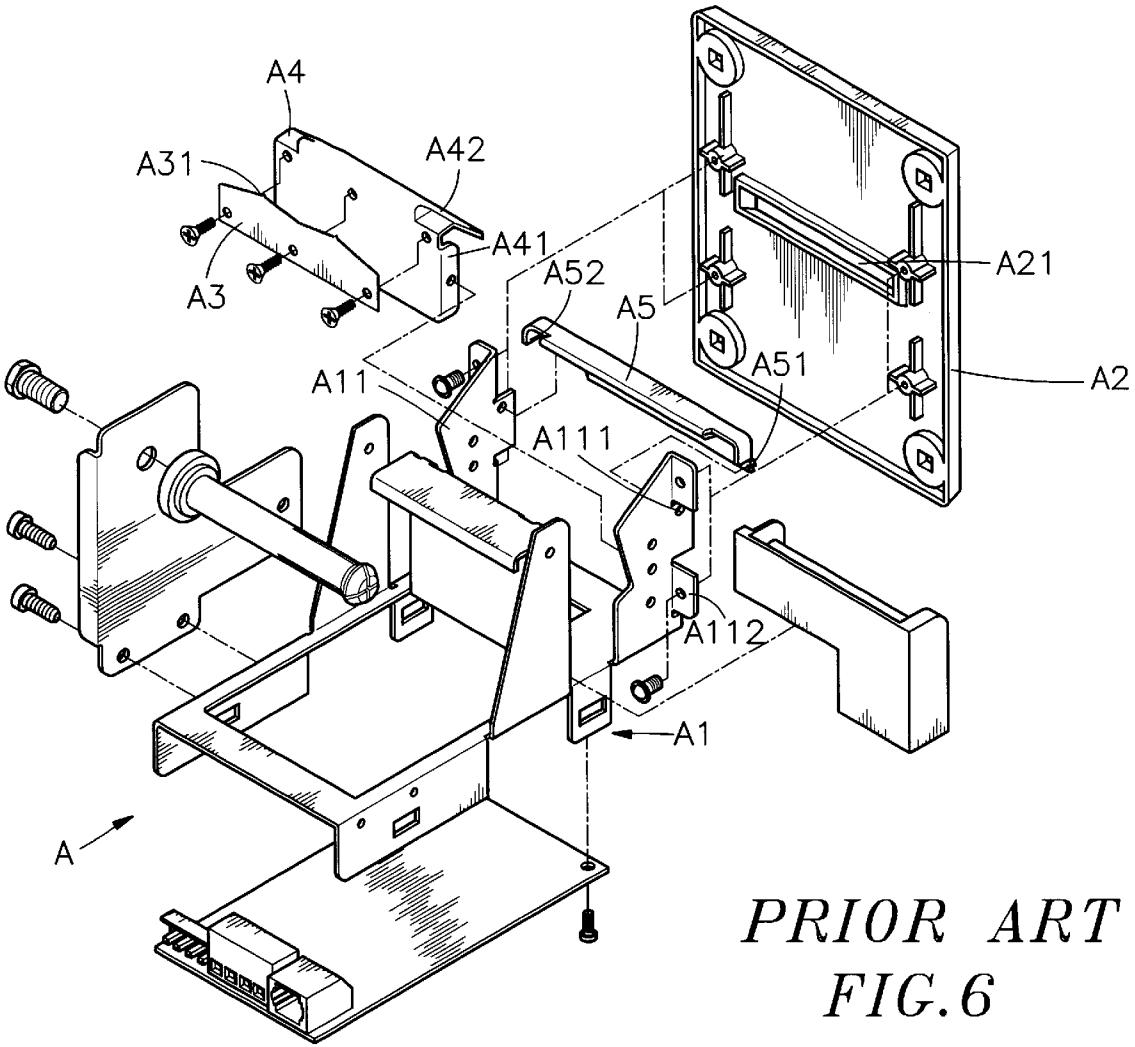
PRIOR ART FIG. 6
FIG. 6 is an exploded view of a ticket vending machine according to the prior art.
Figure 7:
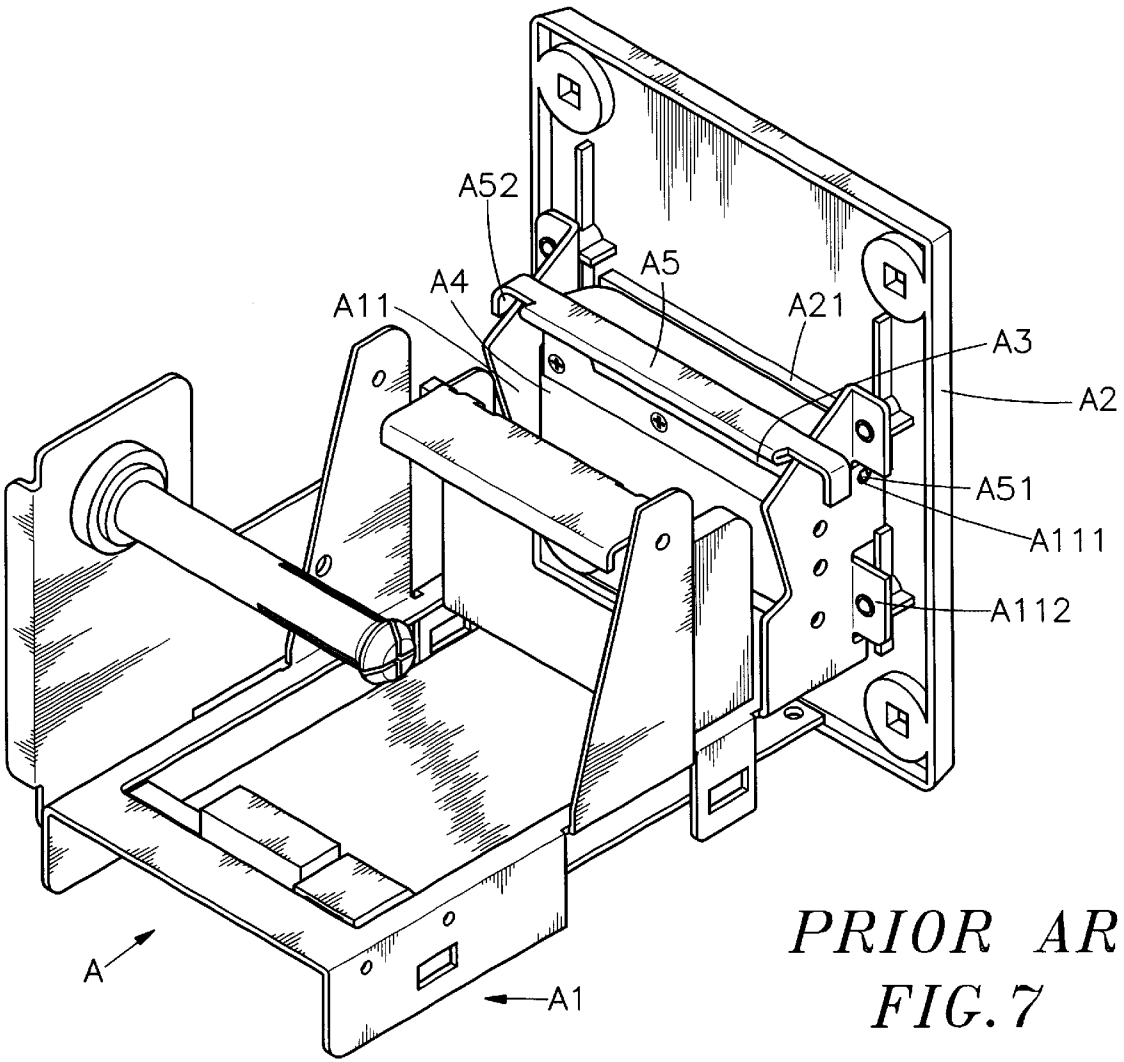
PRIOR ART FIG. 7
FIG. 7 is an elevational assembly view of the ticket vending machine according to the prior art.

Referring to FIG. 5 and FIGS. 1, 3 and 4 again, after loading of a ticket roll on the axle 6, the end flange 62 stop the ticket roll from escaping out of the axle 6. The lead end of the ticket roll is then pulled outwards over the transverse bearing face 121 of the base frame 1, and inserted in proper order through the gear box 31 over the bottom side of the sheet-transfer cylinder assembly 311, the cutting hole 40 of the cutting unit 4, and then the passageway 23 to the ticket outlet 24. Because the cutting hole 40 is spaced from the ticket outlet 24 at a distance, the lead end of the continuous ticket sheet of the ticket roll is kept from sight before each cutting action, preventing people from damaging the continuous ticket sheet of the ticket roll or stealing it.

Referring to FIGS. from 3 through 5 again, when the circuit board 32 of the control unit 3 received a command signal, it immediately drives the gear box 31 to rotate the sheet-transfer cylinder assembly 311, causing the sheet-transfer cylinder assembly 311 to deliver the continuous ticket sheet of the ticket roll forwardly out of the ticket outlet 24 at a distance, and at the same time drives the motor 41 of the cutting unit 4 to rotate the conical screw rod 411. During rotary motion of the conical screw rod 411, the eccentric gear wheel 42 is rotated to move the link 43, thereby causing the cutting plate 45 to be moved by the link 43 relative to the cutting hole 40, and therefore the cutting edge 452 of the cutting plate 45 is forced to cut off the continuous ticket sheet of ticket roll. During the cutting action of the cutting plate 45, the sensor 44 is forced by the D-shaped block 422 to make a displacement, providing a signal to reverse the motor 41, thereby causing the link 43 to move the cutting plate 45 back to its former position.

A prototype of ticket vending machine has been constructed with the features of the annexed drawings of FIGS. 1~5. The ticket vending machine functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A ticket vending machine comprising:

a base frame;

a face panel fixedly mounted on a front side of said base frame, said face panel having a ticket outlet;

a side plate fixedly vertically mounted on one lateral side of said base frame remote from said face panel;

an axle perpendicularly fixedly mounted on said side plate and suspended above said base frame and holding a ticket roll for enabling the lead end of the continuous ticket sheet of said ticket roll to be extended to the ticket outlet of said face panel;

a control unit mounted in said base frame, said control unit comprising a control circuit board, a gear box, and a sheet-transfer cylinder assembly, and controlled by said control circuit board to transfer the continuous ticket sheet of said ticket roll to the ticket outlet of said face panel; and a cutting unit mounted inside said base frame between said gear box and said face panel and adapted to cut off the continuous ticket sheet of said ticket roll;

wherein said face panel is comprised of a first shell and a second shell fastened together, said first shell and said second shell having respective guides defining a passageway adapted to guide the continuous ticket sheet of said ticket roll from said sheet-transfer cylinder assembly to said ticket outlet for enabling the continuous ticket sheet of said ticket roll to be cut by said cutting unit; said cutting unit comprises a horizontal cutting hole through which the continuous ticket sheet of said ticket roll passes from said sheet-transfer cylinder assembly to said ticket outlet, and a cutting plate controlled to reciprocate over said cutting hole and to cut off the continuous ticket sheet of said ticket roll.

2. The ticket vending machine as claimed in claim 1, wherein said cutting unit further comprises a motor, a conical screw rod coupled to said motor, an eccentric gear wheel meshed with said conical screw rod, and a link coupled between said eccentric gear wheel and said cutting plate and adapted to reciprocate said cutting plate upon operation of said motor.

3. The ticket vending machine as claimed in claim 2, wherein said link has a first end provided with an elongated sliding slot coupled to a coupling rod at one side of said eccentric gear wheel, a second end coupled to a fixed rod of said cutting unit, and a middle part coupled to said cutting plate by a slip joint.

4. The ticket vending machine as claimed in claim 3, wherein said cutting unit further comprises a D-shaped block fixedly provided at one side of said eccentric gear wheel opposite to said link, and a sensor coupled to said D-shaped block and adapted to detect the amount of rotation of said eccentric gear wheel and to reverse said motor after rotation of said eccentric gear through a predetermined angle.

5. The ticket vending machine as claimed in claim 1, wherein said cutting plate has a V-shaped cutting edge.

6. The ticket vending machine as claimed in claim 1, wherein said link has a V-shaped profile.

* * * * *